US008146365B2

(12) United States Patent
Shum et al.

(10) Patent No.: US 8,146,365 B2
(45) Date of Patent: Apr. 3, 2012

(54) FUEL NOZZLE PROVIDING SHAPED FUEL SPRAY

(75) Inventors: Frank Shum, Mississauga (CA); Jeffrey Verhiel, Toronto (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1297 days.

(21) Appl. No.: 11/763,119

(22) Filed: Jun. 14, 2007

(65) Prior Publication Data

US 2008/0307791 A1 Dec. 18, 2008

(51) Int. Cl.
*F23R 3/14* (2006.01)
*F23R 3/50* (2006.01)

(52) U.S. Cl. ..... 60/740; 60/748; 60/804

(58) Field of Classification Search ..... 60/740, 60/746, 747, 748, 804
See application file for complete search history.

(56) References Cited

U.S. PATENT DOCUMENTS

| | | | | |
|---|---|---|---|---|
| 2,151,540 | A | | 3/1939 | Varga |
| 2,946,185 | A | | 7/1960 | Bayer |
| 3,213,523 | A | | 10/1965 | Boehler |
| 3,472,025 | A | | 10/1969 | Simmons et al. |
| 3,521,824 | A | | 7/1970 | Wilcox |
| 4,100,733 | A | | 7/1978 | Streibel et al. |
| 4,218,020 | A | | 8/1980 | Reider |
| 4,322,945 | A | | 4/1982 | Peterson et al. |
| 4,327,547 | A | | 5/1982 | Hughes et al. |
| 4,404,806 | A | | 9/1983 | Bell, III et al. |
| 4,483,137 | A | | 11/1984 | Faulkner |
| 4,696,157 | A | | 9/1987 | Barbier et al. |
| 4,726,182 | A | * | 2/1988 | Barbier et al. ..... 60/748 |
| 4,902,409 | A | | 2/1990 | Clark |
| 4,941,617 | A | | 7/1990 | Russell et al. |
| 5,036,657 | A | | 8/1991 | Seto et al. |
| 5,211,005 | A | * | 5/1993 | Hovnanian ..... 60/739 |
| 5,231,833 | A | | 8/1993 | Maclean et al. |
| 5,253,471 | A | | 10/1993 | Richardson |
| 5,271,219 | A | | 12/1993 | Richardson |
| 5,331,805 | A | * | 7/1994 | Myers et al. ..... 60/748 |
| 5,351,475 | A | | 10/1994 | Ansart et al. |
| 5,396,759 | A | | 3/1995 | Richardson |
| 5,400,968 | A | | 3/1995 | Sood |
| 5,419,115 | A | | 5/1995 | Butler et al. |
| 5,423,178 | A | | 6/1995 | Mains |
| 5,570,580 | A | | 11/1996 | Mains |
| 5,579,645 | A | | 12/1996 | Prociw et al. |
| 5,598,696 | A | | 2/1997 | Stotts |

(Continued)

FOREIGN PATENT DOCUMENTS

| | | |
|---|---|---|
| CA | 1013153 | 7/1977 |

(Continued)

OTHER PUBLICATIONS

International Search Report of PCT/CA2008/001141.

*Primary Examiner* — Ted Kim
(74) *Attorney, Agent, or Firm* — Norton Rose Canada LLP

(57) ABSTRACT

A fuel injection nozzle for a gas turbine engine has a central fuel ejection nozzle and a plurality of airflow passages within the spray tip that include a first and second group of circumferentially spaced apart fuel-spray forming airflow passages disposed on opposite sides of a transverse axis and oriented towards each other such as to produce opposed fuel spray shaping air jets which generate a shaped final fuel spray.

25 Claims, 6 Drawing Sheets

U.S. PATENT DOCUMENTS

| | | | | |
|---|---|---|---|---|
| 5,622,489 | A | 4/1997 | Monro | |
| 5,679,135 | A | 10/1997 | Carl | |
| 5,737,921 | A | 4/1998 | Jones et al. | |
| 5,771,696 | A | 6/1998 | Hansel et al. | |
| 5,848,525 | A | 12/1998 | Spencer | |
| 5,941,076 | A * | 8/1999 | Sandelis | 60/752 |
| 5,956,955 | A | 9/1999 | Schmid | |
| 5,983,642 | A | 11/1999 | Parker et al. | |
| 5,996,335 | A | 12/1999 | Ebel | |
| 6,024,301 | A | 2/2000 | Hurley et al. | |
| 6,082,113 | A | 7/2000 | Prociw et al. | |
| 6,109,038 | A | 8/2000 | Sharifi et al. | |
| 6,119,459 | A | 9/2000 | Gomez et al. | |
| 6,141,968 | A | 11/2000 | Gates et al. | |
| 6,149,075 | A | 11/2000 | Moertle et al. | |
| 6,240,732 | B1 | 6/2001 | Allan | |
| 6,247,317 | B1 | 6/2001 | Kostka | |
| 6,256,995 | B1 | 7/2001 | Sampath et al. | |
| 6,289,676 | B1 | 9/2001 | Prociw et al. | |
| 6,463,739 | B1 | 10/2002 | Mueller et al. | |
| 6,625,971 | B2 | 9/2003 | Graves | |
| 6,676,048 | B1 | 1/2004 | Tiemann | |
| 6,761,035 | B1 | 7/2004 | Mueller | |
| 6,871,488 | B2 | 3/2005 | Oskooei et al. | |
| 7,117,678 | B2 | 10/2006 | Sampath et al. | |
| 7,721,545 | B2 * | 5/2010 | Cayre et al. | 60/737 |
| 7,891,190 | B2 * | 2/2011 | Commaret et al. | 60/748 |
| 2003/0014979 | A1 | 1/2003 | Summerfield et al. | |
| 2004/0040306 | A1 | 3/2004 | Prociw et al. | |
| 2005/0039456 | A1 | 2/2005 | Hayashi | |

FOREIGN PATENT DOCUMENTS

| | | |
|---|---|---|
| CA | 2307186 | 5/1999 |
| EP | 0 660 038 | 6/1995 |
| EP | 0 732 547 | 9/1996 |
| EP | 0 939 275 | 9/1999 |
| EP | 1 069 377 | 1/2001 |
| GB | 2 404 976 | 2/2004 |
| WO | WO-9504244 | 2/1995 |
| WO | WO-2007/043820 | 4/2007 |

* cited by examiner

FUEL NOZZLE PROVIDING SHAPED FUEL SPRAY

TECHNICAL FIELD

The invention relates generally to gas turbine engines and, more particularly, to fuel nozzles for such engines.

BACKGROUND OF THE ART

Gas turbine engine combustors employ a plurality of fuel nozzles, typically arranged in an annular configuration, to spray the fuel into the combustion chamber of an annular combustor. Each of these fuel nozzles generates a spray of fuel which is generally conical in shape and which defines a generally circular cross-sectional profile, as shown in FIG. 6*b* for example. However, in order to achieve a complete fuel spray coverage in annular combustors, a relatively large number of fuel nozzles are required about the combustor. Further, as the overall shape of the fuel spray produced is fixed, no alternatives exist for controlling the density and profile of fuel sprays in the combustor.

Accordingly, there is a need for an improved fuel nozzle for a gas turbine engine combustor which permits, inter alia, a reduction in the total number of parts of such combustors and thus lowers overall production costs.

SUMMARY OF THE INVENTION

It is therefore an object of this invention to provide an improved fuel nozzle for a gas turbine engine.

In one aspect, the present invention provides a fuel nozzle for use in a combustor of a gas turbine engine, the fuel nozzle comprising: a nozzle body defining at least one fuel flow passage therethrough; a spray tip mounted to the nozzle body, the spray tip having a central fuel ejection nozzle in flow communication with the at least one fuel flow passage and defining a fuel spray axis, the central fuel ejection nozzle ejecting fuel out of the spray tip in an initially conical fuel spray about the fuel spray axis; at least a first series of airflow passages disposed in said spray tip radially outwardly from the central fuel ejection nozzle, said first series of airflow passages including opposed groups of airflow passages, said opposed groups of airflow passages being circumferentially spaced apart and located on opposite sides of a transverse axis extending through said central fuel ejection nozzle perpendicularly to said fuel spray axis; and wherein said opposed groups of said first series of airflow passages are oriented towards said transverse axis such as to produce opposed fuel spray shaping air jets which intersect the initially conical fuel spray to generate a differently shaped final fuel spray.

In another aspect, the present invention provides a gas turbine engine combustor assembly comprising: a combustor liner enclosing a combustion chamber, the combustor liner having an annular dome portion; a plurality of fuel nozzles disposed in the annular dome portion for injecting fuel into the combustion chamber, the fuel nozzles being equally circumferentially spaced apart about the annular dome portion to define an annular axis interconnecting the fuel nozzles, each of said fuel nozzles including: a spray tip having a central fuel ejection nozzle in flow communication with at least one fuel flow passage which receives fuel from a fuel source, the central fuel ejection nozzle defining a fuel spray axis and ejecting fuel into the combustion chamber in an initially conically shaped fuel spray about the fuel spray axis; a first series of airflow passages disposed in said spray tip radially outwardly from the central fuel ejection nozzle, said airflow passages including opposed groups of airflow passages, said opposed groups of airflow passages being circumferentially spaced apart in the spray tip and located on opposite sides of a transverse axis extending through said central fuel ejection nozzle perpendicularly to said fuel spray axis; said opposed groups of airflow passages being oriented towards said transverse axis such as to produce opposed fuel spray shaping air jets, said fuel spray shaping air jets intersecting said initially conical fuel spray such as to generate a final fuel spray having an elliptical cross-sectional shape defining a major axis parallel to said transverse axis and a minor axis perpendicular thereto.

In yet another aspect, the present invention provides a fuel injection system of a gas turbine engine, the system comprising a fuel manifold, a plurality of nozzles mounted to said manifold and having spray tips for injecting an air/fuel mixture into a combustor of the gas turbine engine, at least one of said nozzles having a central fuel ejection nozzle and defining therein at least one fuel flow passage providing fluid flow communication between said fuel manifold and said central fuel ejection nozzle, a plurality of airflow passages disposed within said spray tip, the airflow passages including at least a first and second group of circumferentially spaced apart fuel-spray shaping airflow passages disposed on opposite sides of a transverse axis and oriented towards each other such as to produce opposed fuel spray shaping air jets, said fuel spray shaping air jets intersecting a fuel spray ejected out of said central fuel ejection nozzle to generate a shaped final fuel spray.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
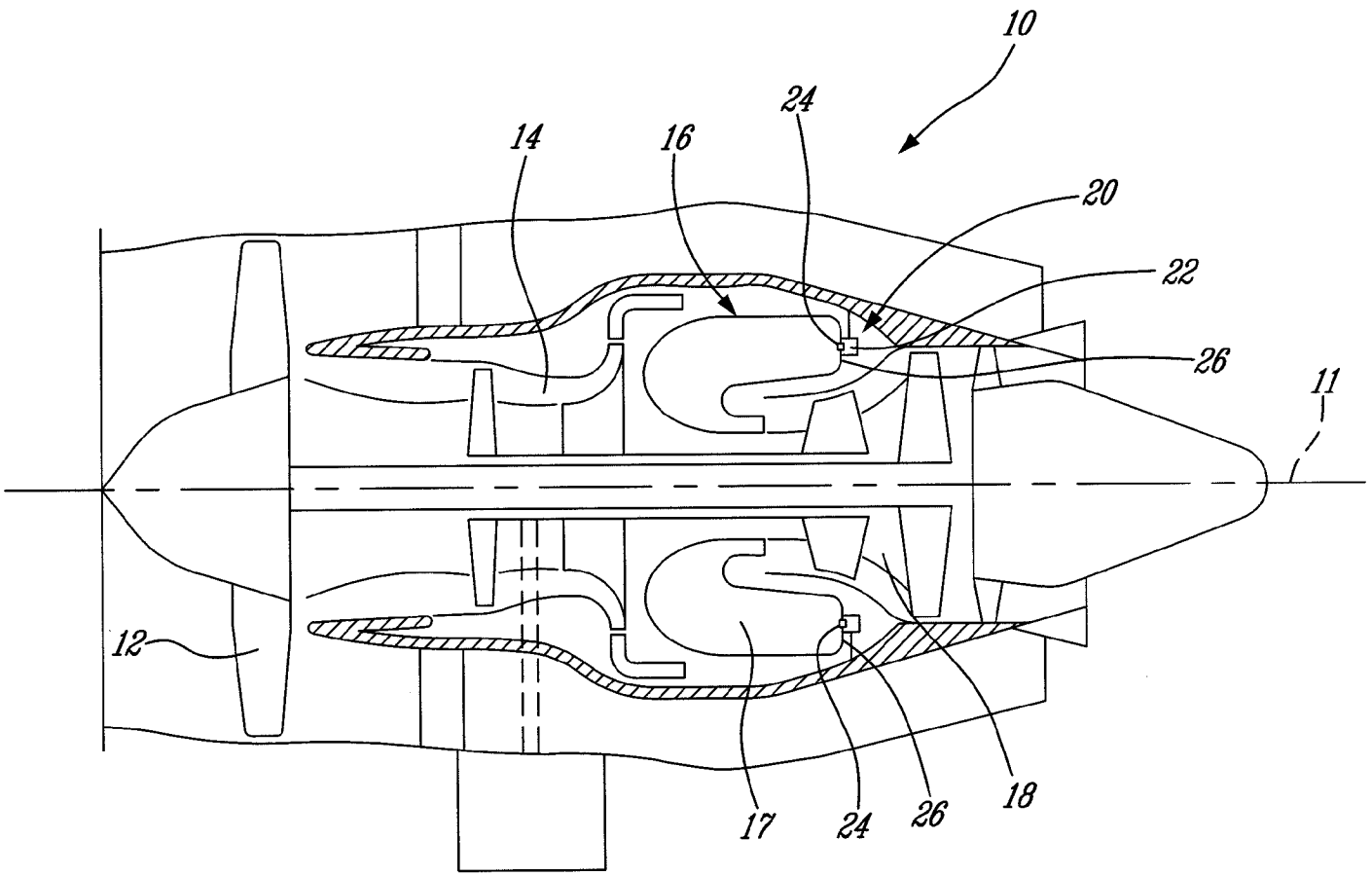
FIG. 1 is a schematic cross-sectional side view of a gas turbine engine in which the present invention can be used.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Fuel is injected into the combustor 16 of the gas turbine engine 10 by a fuel injection system 20, which includes a fuel source (not shown), at least one fuel conveying assembly or internal fuel manifold 22 and a number of fuel nozzles 24 engaged with the fuel manifold and which are operable to inject fuel into the combustor 16 for mixing with the compressed air from the compressor 14 and ignition of the resultant mixture. The fan 12, compressor 14, combustor 16, and turbine 18 are preferably all concentric about a common central longitudinal axis 11 of the gas turbine engine 10. The combustor 16 is annular (and in at least one embodiment, an annular reverse flow combustor), and thus defines both an annular internal combustion chamber 17 therewithin and an annular upstream or dome end wall 26 through which the fuel nozzles 24 protrude for injecting the air/fuel mixture into the combustion chamber 17 of the combustor 16.

Figure 2:
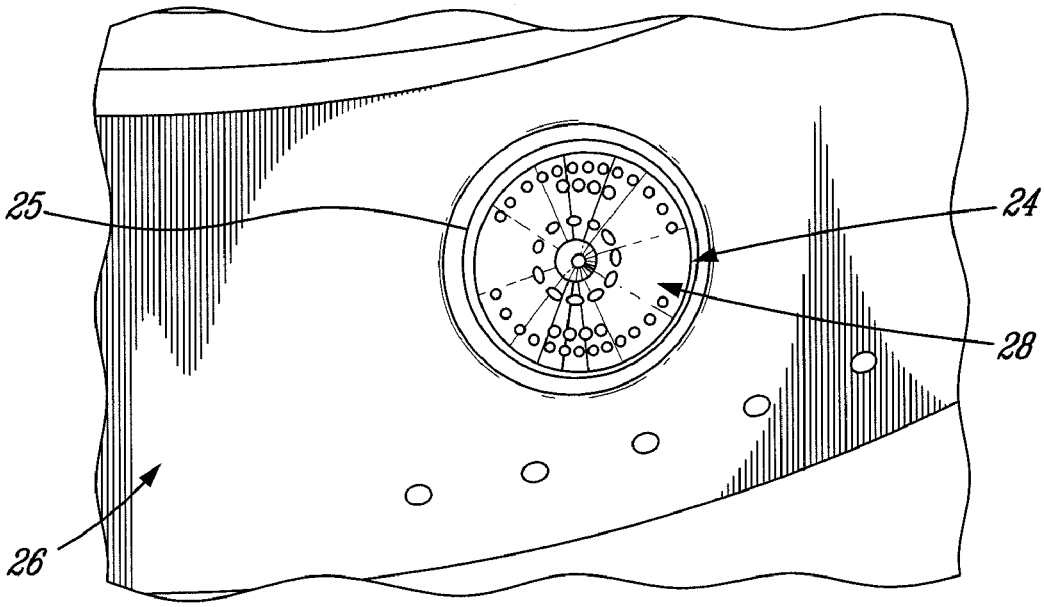
FIG. 2 is a three dimensional view of a portion of a combustor having a fuel nozzle in accordance with one aspect of the present invention.

Referring to FIG. 2, at least the spray tip 28 of a fuel nozzle 24 is received within an opening 25 in the annular dome end 26 of the liner of the combustor 16, for ejecting the air/fuel mixture into the combustor's combustion chamber. A plurality of the fuel nozzles 24 are provided about the full circumference of the annular dome 26, and in at least one embodiment are equally spaced therearound. Thus, the plurality of fuel nozzles 24 define an annular axis 96 (see FIG. 6*a*) which interlinks the fuel nozzles and extends circumferentially about the dome end of the combustor. While relative spacing of the circumferentially arranged fuel nozzles 24 may be varied as required, the fuel nozzles 24 permit an overall combustor and fuel injection assembly which requires fewer fuel nozzles relative to most currently employed fuel injection systems for gas turbine engines.

Figure 6A:
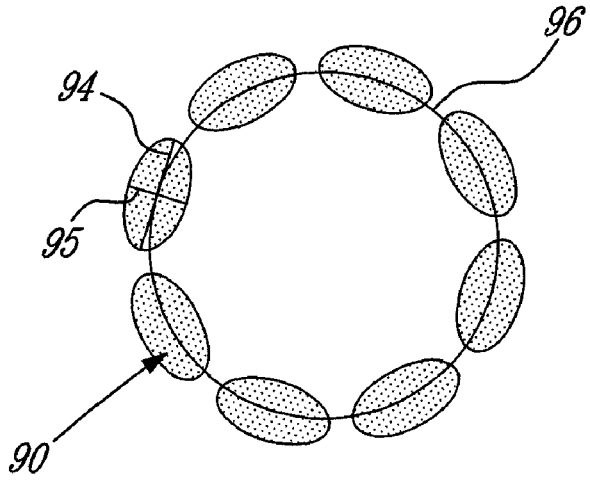
FIG. 6*a* is a plan view of a schematic representation of spray coverage produced by the fuel nozzles of the present invention.
Figure 6B:
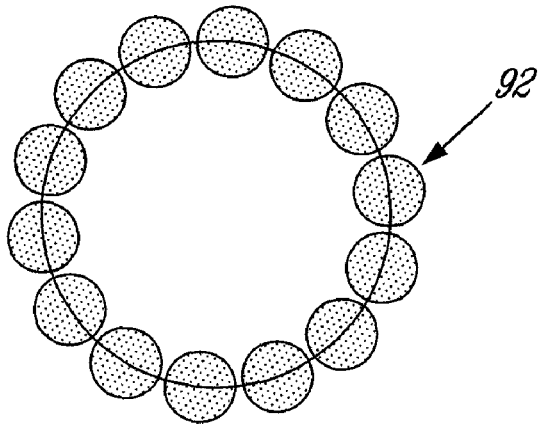
FIG. 6B (PRIOR ART)
FIG. 6*b* is a plan view of a schematic representation of spray coverage produced by fuel nozzles of the prior art.

As seen in FIG. 6*b*, most fuel injection nozzles of the prior art generate a circular final fuel spray 92, i.e. having a profile that defines a generally circular transverse cross-sectional shape. Thus, in order to provide adequate coverage of sprayed fuel within the annular combustor, a relatively large number of standard fuel nozzles must be provided and located in a relatively closely spaced arrangement, such as that depicted in FIG. 6*b*. Conversely, as described further below, the fuel nozzles 24 described herein can generate, in at least one embodiment thereof, a generally elliptically shaped fuel spray 90, i.e. having a generally elliptical transverse cross-sectional shape, as depicted in FIG. 6*a*. As will be described, however, other shapes of the final fuel spray are possible with the fuel nozzles described herein, which can be desired in order to produce a variety of possible final fuel spray shapes, as desired and/or required. As can be seen in FIG. 6*a*, when elliptically shaped fuel sprays 90 are produced, fewer fuel nozzles 24 producing such an elliptically shaped fuel spray 90 are needed (relative to those which produce a circular spray profile 92), in order to adequately cover the annular profile of a similarly sized combustor. Fewer fuel nozzles means lower production, assembly and operating costs, and also means lower overall weight, all of which are desirable improvements for gas turbine engines. Each of the elliptically shaped fuel spray profiles 90 defines a major axis 94 and a minor axis 95, the major axis being longer than the minor axis. In at least one embodiment, the fuel nozzles 24, and therefore their resulting elliptical spray shapes 90, are oriented such that the major axis 94 of the elliptical fuel spray 90 is substantially tangent to the annular axis 96 interlinking the fuel nozzles 24 about the combustor dome 26. Other orientations remain possible, much as fewer or more fuel nozzles may be used as required given the particular combustor. Although FIG. 6*a* depicts all fuel sprays in the combustor being shaped, and therefore all fuel nozzles being of the type described therein, it is to be understood that only certain fuel nozzles within the combustor may be of the type described herein. This would result in different fuel nozzles in the combustor producing different fuel spray profiles.

Figure 3:
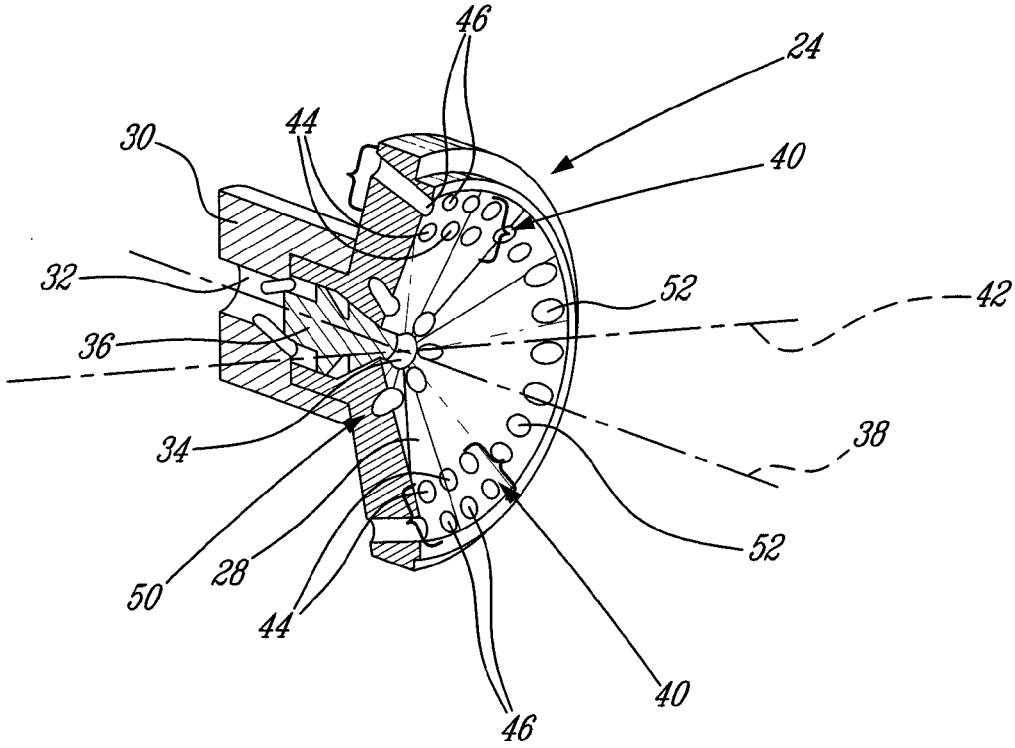
FIG. 3 is an isometric, partially sectioned, view of a fuel nozzle according to another aspect of the present invention.

Referring back to FIG. 3, the fuel nozzles 24 include an outer spray tip 28 including a central fuel ejection nozzle 34 located at the center of the circular spray tip, the spray tip 28 being mounted to a nozzle body portion 30 through which at least one fuel flow passage 32 is defined. In at least one embodiment, the spray tip 28 is substantially circular in shape (i.e. the perimeter of the transverse cross-section thereof is substantially circular). In the fuel nozzle 24 of FIG. 3, the entire spray tip portion 28 is integrally formed and mounted as a single piece to the nozzle body portion 30. The fuel flow passage 32 is in fluid flow communication with a fuel source (not shown) in order to provide a feed of fuel to the fuel nozzle 24, via the fuel manifold 22 (see FIG. 1) or other suitable fuel distribution members of the fuel injection system 20. In at least one embodiment, wherein the fuel manifold 22 is an internal manifold mounted within the gas generator casing in close proximity to the outer surface of the combustor dome 26, the nozzle body 30 is mounted directly to the internal fuel manifold 22. The fuel nozzle 24 may be a so-called "simplex" fuel nozzle as depicted in FIG. 3, wherein only a single fuel flow passage 32 is provided and thus the fuel ejection nozzle 34 ejects a single initially conical spray of fuel. Alternately, as will be described further below with reference to FIG. 4, the fuel nozzle of the present invention may be of the "duplex" type. A flow restrictor 36 is disposed within the fuel flow passage 32 in order to control the volume of fuel flowing out through the fuel ejection nozzle 34. As noted above, and as best seen in FIGS. 7*a* and 7*b*, upon initial ejection from the fuel ejection nozzle 34, a generally conically shaped fuel spray 21 is initially produced, the conical fuel spray being concentric about a central fuel spray axis 38 extending from the central fuel ejection nozzle 34 into the combustion chamber 17.

The spray tip 28 of the fuel nozzle 24 also provides air flow which mixes with the fuel spray ejected from the fuel ejection nozzle 34, which helps to achieve a desired final air/fuel mixture which is sprayed into the combustor for combustion. In order to provide the air flow, the spray tip 28 includes a number of airflow passages therein.

These airflow passages include at least a first series of airflow passages 40 disposed in a radially outer region of the spray tip 28, i.e. radially outward from the central fuel ejection nozzle 34. The first series of airflow passages 40 includes two opposed groups of airflow passages, namely an outer group and an inner group, which are circumferentially spaced apart about the circular spray tip 28 and located on opposite sides of a transverse axis 42 that extends through the central fuel ejection nozzle 34 and thus both intersects and is substantially perpendicular to the fuel spray axis 38. The transverse axis 42 corresponds to the major axis 94 of the final elliptical spray 90 produced by the fuel nozzles 24, as described above relative to FIG. 6*a*. Therefore, the fuel nozzles 24 may, in one possible embodiment, be arranged and orientated within the combustor 16 such that the transverse axes 42 of each of the fuel nozzles 24 is substantially tangent to the annular axis 96 (see FIG. 6*a*) interconnecting the circumferentially spaced apart fuel nozzles 24 at the annular dome portion 26 of the combustor. In at least one embodiment, the opposed groups of the first series of airflow passages 40 are symmetric with respect to the transverse axis 42.

As shown in FIG. 3, in at least one possible embodiment, each of the groups of the first series of airflow passages 40 includes two rows of airflow passages, namely a radially inner set of passages 44 and a radially outer set of passage 46. In one embodiment, these arcuate rows of passages 44,46 are parallel to each other but slightly circumferentially offset such that at least the exit apertures of the inner passages 44 are not circumferentially aligned with the radially outer passages 46. This enables a more evenly distributed flow of air produced by each of the opposed groups 40 of airflow passages. In one possible embodiment, the first series of airflow passages 40 all define a substantially circular cross-sectional shape along at least a portion thereof, whether at the exit openings thereof or along their entire length. Each of the two opposed groups 40 of the first series of airflow passages are preferably inclined in the spray tip 28, such that they are respectively oriented towards each other and thus towards the intermediate transverse axis 42.

Figure 7A:
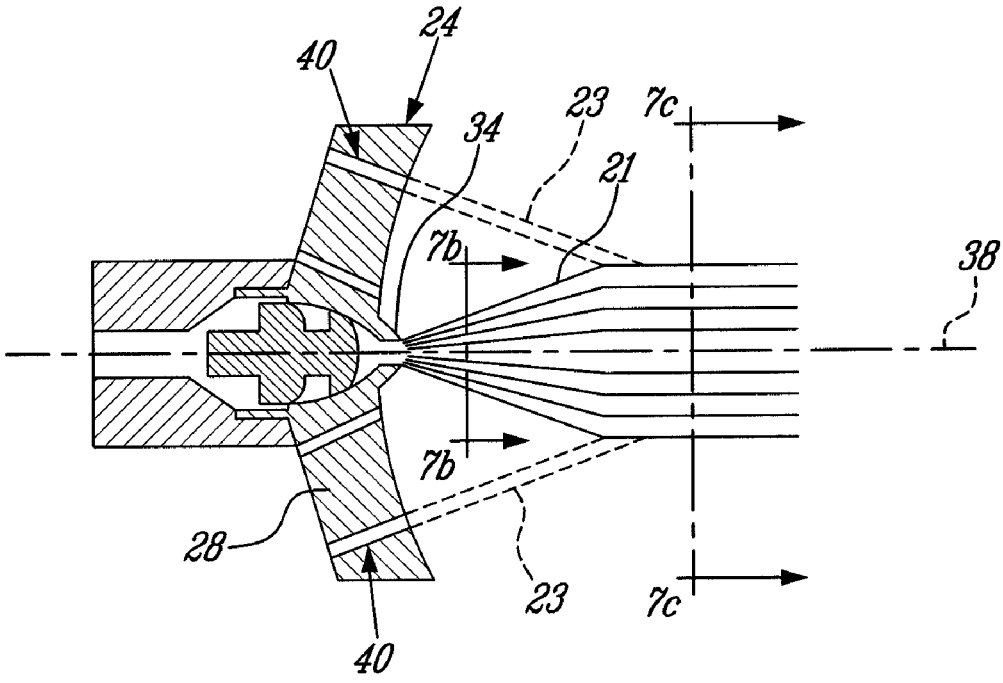
FIG. 7*a* is a schematic cross-sectional view of the fuel nozzle of FIG. 3, showing the shaping of the fuel spray being ejected therefrom.
Figure 7B:
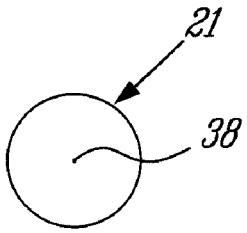
FIG. 7*b* is a cross-section of the initially fuel spray, taken through line 7*b*-7*b* of FIG. 7*a*.
Figure 7C:
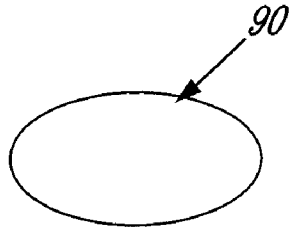
FIG. 7*c* is a cross-sectional of the final shaped fuel spray, taken through line 7*c*-7*c* of FIG. 7*a*.

As seen in FIGS. 7*a*-7*c*, the opposed groups 40 of the first series of airflow passages defined in the spray tip 28 of the fuel nozzles 24 thereby produce opposed fuel spray shaping air jets 23 which will intersect the initially conical fuel spray 21 ejected out of the central fuel ejection nozzle 34, thereby forming or shaping the fuel spray and thus generating a final fuel spray 90 which is differently shaped from the initial, conical, fuel spray. In the depicted embodiment, this shaped final fuel spray 90 is substantially elliptical, however other shapes of the final fuel spray are possible (i.e. the spray shaping air jets 23 form the fuel spray into a differently shaped final fuel spray). In the depicted embodiment, once the fuel spray shaping air jets 23 produced by the air flowing through the opposed groups 40 of the first series of airflow passages intersect the initially conical fuel spray 21 ejected from the nozzle 34, the air jets 23 act to flatten out the conical fuel spray 21 such as to generate the elliptically shaped final fuel spray 90 that exits from the fuel nozzle 24 into the combustion chamber. This elliptical fuel spray 90, as noted above with respect to FIG. 6*a*, defines a major axis 94 and a minor axis 95, the major axis 94 being at least parallel, and preferably coincident with, the transverse axis 42 of the fuel nozzle.

It is to be understood that this elliptically shaped final fuel spray produced by the fuel spray shaping air jets of the fuel nozzles 24 is but one possible configuration and/or shape which can be generated by directing the shaping air jets onto the initially conical fuel spray. For example, the final fuel spray generated by the fuel nozzles 24 can be substantially flat, rectangular, oblong or any other possible different spray shape which the initial spray can be shaped or formed into and which may be suitable in a gas turbine engine combustor. The first series of airflow passages 40 which produce the opposed fuel spray shaping air jets may be angled within the spray tips such that, in additional to producing spray shaping air jets which will be directed at least partially towards to the central fuel ejection axis, may be angles at least partially tangentially about the spray tip such as to produce a swirling flow about this central fuel ejection axis of the fuel nozzle. Thus, the fuel spray shaping air jets can also impart, in one embodiment, swirling motion to the fuel spray being ejected.

The spray tip 28 of the fuel nozzle 24 also includes, in at least one embodiment, a second series of airflow passages 50. The airflow passages of this second series 50 are located radially inwardly of the first series of airflow passages 40 on the spray tip, but still radially outward of the central fuel ejection nozzle 34. The second series 50 of airflow passages are disposed circumferentially about the central fuel ejection nozzle 34 in close proximity thereto. The airflow passages of this second series 50 are equally spaced apart and form an annular group of airflow passages which direct air directly into the initially conical fuel spray being ejected out of the fuel spray nozzle 34. The airflow provided by the second series 50 of airflow passages aids with the atomization of the fuel, however does not substantially change the shape of the fuel spray profile. The apertures of the second series of airflow passages 50 may also define a circular cross-sectional shape, and may be commonly angled or inclined within the spray tip such as to produce a ring of swirling air flowing out of the exit openings thereof.

As seen in FIG. 3, additional airflow passages may also be provided in the spray tip 28 of the fuel nozzle. For example, the spray tip 28 includes another set of airflow passages 52 which are located about the outer periphery of the circular spray tip 28, circumferentially between the opposed groups of the first series of airflow passages 40. These arcuate groups of passages 52 at the periphery of the spray tip may be used to provide more airflow into the combustor, however the volume of air delivered through these additional airflow passages 52 is not sufficient to detract from, or cancel out the effect of, the spray shaping air jets produced by the opposed groups of the first series of airflow passages 40.

Figure 4:
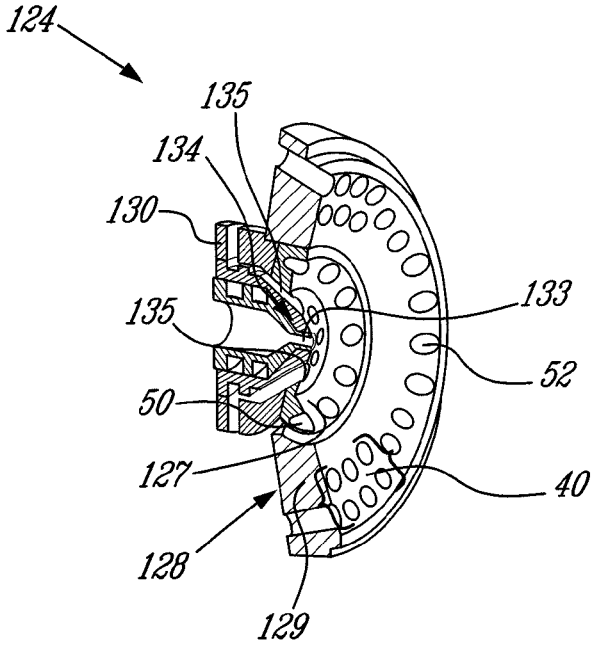
FIG. 4 is an isometric, partially sectioned, view of a fuel nozzle according to another aspect of the present invention.

Referring now to FIG. 4, the fuel nozzle 124 is similar to the fuel nozzle 24 described above, however the spray tip 128 of the fuel nozzle 124 is formed of two separate parts, namely a central portion 127, which includes the centrally located fuel ejection nozzle 134 and is mounted to the nozzle body 130, and a radially outer spray tip ring portion 129, which is mounted to the central portion 127 of the spray tip 128. In this embodiment, the first series of airflow passages 40 are located in the spray tip ring portion 129, and the second series of airflow passages 50 are located in the central portion 127. In this embodiment, as the outer spray tip ring 129 is a separate part from the central portion 127 of the spray tip, existing standard fuel nozzles having such a two part construction with a central portion can be retrofitted with the outer spray tip rings 129 in order to "convert" a regular, conical fuel spray nozzle into one of the present invention which will produce an elliptical fuel spray profile. The fuel nozzle 124 is also a "duplex" type fuel nozzle, and therefore has two separate concentric fuel feeds in the nozzle body portion 130 separately providing fuel to the fuel spray nozzle 134. Thus, a primary fuel flow is ejected by the fuel spray nozzle 134 via the central spray tip 133, while secondary fuel is ejected through a small annulus around the central tip 133. Air openings 135, which are radially disposed between the central spray tip 133 and the second series of airflow passages 50, provide air flow to the fuel spray much as per the air passages 50 in the embodiment of FIG. 3. The first and second series of airflow passages 40 and 50, as well as the additional outer airflow passages 52, are also otherwise the same as those described above with respect to the fuel nozzle 24.

Figure 5:
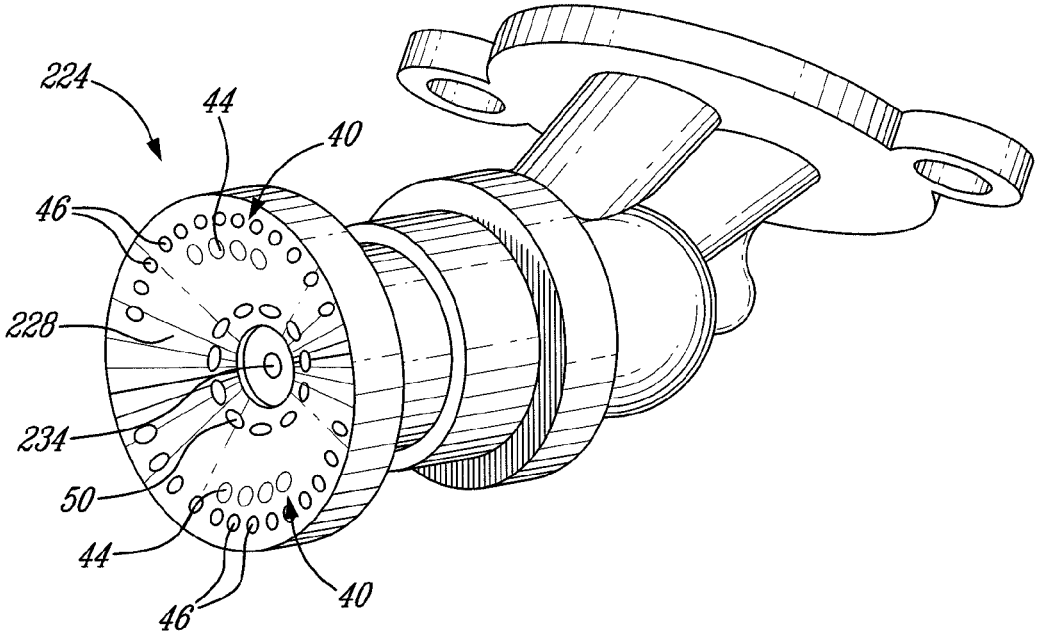
FIG. 5 is an isometric view of a fuel nozzle assembly according to another aspect of the present invention.

Referring to FIG. 5, the fuel nozzle 224 is a fuel nozzle assembly which has been retrofitted by adding a spray tip 228 air swirler in accordance with one alternate embodiment of the present invention to the existing central fuel ejection nozzle portion 234. Thus, the entire spray tip 228 is of a one-piece construction, and includes both the outer first series of airflow passages 40 which produce the fuel spray shaping jets, as well as the ring of inner airflow passages 50 which aid in the atomization of the fuel spray but do not otherwise substantially alter the overall shape of the fuel spray. Each of the opposed groups of the first series of airflow passages 40, which produce the fuel spray shape forming air jets therefrom, include an outer arcuate row of passages 46 and an inner arcuate row of passages 44. In the embodiment of FIG. 5, the radially outer arcuate row of airflow passage 46 is longer (i.e. comprises more apertures and thus more openings in the outer surface of the spray tip) than is the inner arcuate row of airflow passages 44. It is to be understood that all embodiments described above may include this configuration of the array of holes and passages of the first series of passages 40. The relative number of passages in each of the inner and outer rows 44, 46, as well as their relative diameters, may be selected such as to achieve a desire overall size, and shape of the elliptical fuel spray profile produced by the fuel nozzle.

Other modifications are of course possible, and the above description is meant to be exemplary only. One skilled in the art will recognize that changes may be made to the embodiments described without departing from the scope of the invention disclosed. For example, the number, size, layout and arrangement of the airflow apertures in the spray tip of the fuel nozzle may be varied, while nonetheless using opposed groups of airflow apertures to produce fuel spray shaping air jets that create an elliptically shaped final fuel spray profile. Still other modifications which fall within the scope of the present invention will be apparent to those skilled in the art, in light of a review of this disclosure, and such modifications are intended to fall within the appended claims.

The invention claimed is:

1. A fuel nozzle for use in a combustor of a gas turbine engine, the fuel nozzle comprising:

a nozzle body defining at least one fuel flow passage therethrough;

a spray tip mounted to the nozzle body, the spray tip having a central fuel ejection nozzle in flow communication with the at least one fuel flow passage and defining a fuel spray axis, the central fuel ejection nozzle ejecting fuel out of the spray tip in an initially conical fuel spray about the fuel spray axis;

at least a first series of airflow passages disposed in said spray tip radially outwardly from the central fuel ejection nozzle, said first series of airflow passages being circumferentially discontinuous and including opposed groups of airflow passages, said opposed groups of airflow passages being circumferentially spaced apart by regions substantially free of airflow passages and located on opposite sides of a transverse axis extending through said central fuel ejection nozzle perpendicularly to said fuel spray axis; and wherein said opposed groups of said first series of airflow passages are oriented towards said transverse axis such as to produce opposed fuel spray shaping air jets which intersect the initially conical fuel spray to generate a narrower final fuel spray directed at least partially toward the fuel spray axis.

2. The fuel nozzle as defined in claim 1, wherein the fuel spray shaping air jets form a final fuel spray having a substantially elliptical transverse cross-sectional shape, having a major axis parallel to said transverse axis and a minor axis perpendicular thereto.

3. The fuel nozzle as defined in claim 1, wherein said opposed groups of airflow passages are symmetric with respect to said transverse axis.

4. The fuel nozzle as defined in claim 1, wherein the spray tip includes a second series of airflow passages disposed in said spray tip circumferentially about the central fuel ejection nozzle and located radially inwards of the first series of airflow passages.

5. The fuel nozzle as defined in claim 4, wherein said second series of airflow passages include passage exit openings in said spray tip that are evenly circumferentially spaced apart about the central fuel ejection nozzle, the second series of airflow passages directing a substantially symmetric annular airflow to the initially conical fuel spray.

6. The fuel nozzle as defined in claim 5, wherein each passage of said second series of airflow passages defines a substantially circular cross-sectional area.

7. The fuel nozzle as defined in claim 5, wherein passages of said second series of airflow passages are inclined such as to produce a swirling airflow therefrom.

8. The fuel nozzle as defined in claim 1, wherein at least a portion of said passages of said first series of airflow passages define a substantially circular cross-sectional area.

9. The fuel nozzle as defined in claim 8, wherein said passages of said first series of airflow passages have exit openings having substantially circular cross-sectional areas.

10. The fuel nozzle as defined in claim 1, wherein the spray tip includes a central portion mounted to the nozzle body and a separate air swirler portion mounted to the central portion, the first series of airflow passages being disposed in said separate air swirler portion.

11. The fuel nozzle as defined in claim 1, wherein the spray tip is substantially circular.

12. A gas turbine engine combustor assembly comprising:

a combustor liner enclosing a combustion chamber, the combustor liner having an annular dome portion;

a plurality of fuel nozzles disposed in the annular dome portion for injecting fuel into the combustion chamber, the fuel nozzles being equally circumferentially spaced apart about the annular dome portion to define an annular axis interconnecting the fuel nozzles, each of said fuel nozzles including:

a spray tip having a central fuel ejection nozzle in flow communication with at least one fuel flow passage which receives fuel from a fuel source, the central fuel ejection nozzle defining a fuel spray axis and ejecting fuel into the combustion chamber in an initially conically shaped fuel spray about the fuel spray axis;

a first series of airflow passages disposed in said spray tip radially outwardly from the central fuel ejection nozzle, said airflow passages being circumferentially discontinuous and including opposed groups of airflow passages, said opposed groups of airflow passages being circumferentially spaced apart in the spray tip by regions substantially free of airflow passages and located on opposite sides of a transverse axis extending through said central fuel ejection nozzle perpendicularly to said fuel spray axis; said opposed groups of airflow passages being oriented towards said transverse axis such as to produce opposed fuel spray shaping air jets, said fuel spray shaping air jets intersecting said initially conical fuel spray such as to generate a final fuel spray having a narrower elliptical cross-sectional shape directed at least partially toward the fuel spray axis and defining a major axis parallel to said transverse axis and a minor axis perpendicular thereto.

13. The combustor as defined in claim 12, wherein the transverse axis is substantially tangential to said annular axis interconnecting the fuel nozzles about the dome portion of the combustor.

14. The fuel nozzle as defined in claim 12, wherein said opposed groups of airflow passages are symmetric with respect to said transverse axis.

15. The fuel nozzle as defined in claim 12, wherein the spray tip includes a second series of airflow passages disposed in said spray tip circumferentially about the central fuel ejection nozzle and located radially inwards of the first series of airflow passages.

16. The fuel nozzle as defined in claim 15, wherein said second series of airflow passages include passage exit openings in said spray tip that are evenly circumferentially spaced apart about the central fuel ejection nozzle, the second series of airflow passages directing a substantially symmetric annular airflow to the initially conical fuel spray.

17. The fuel nozzle as defined in claim 12, wherein the spray tip includes a central portion mounted to a nozzle body and a separate air swirler portion mounted to the central portion, the central portion including the central fuel ejection nozzle formed therein, and the first series of airflow passages being disposed in said separate air swirler portion.

18. A fuel injection system of a gas turbine engine, the system comprising a fuel manifold, a plurality of nozzles mounted to said manifold and having spray tips for injecting an air/fuel mixture into a combustor of the gas turbine engine, at least one of said nozzles having a central fuel ejection nozzle and defining therein at least one fuel flow passage providing fluid flow communication between said fuel manifold and said central fuel ejection nozzle, a plurality of airflow passages disposed within said spray tip and being circumferentially discontinuous thereabout, the airflow passages including at least a first and second group of fuel-spray shaping airflow passages circumferentially spaced apart by regions substantially free of airflow passages, the first and second groups of fuel-spray shaping airflow passages being disposed on opposite sides of a transverse axis and oriented towards each other such as to produce opposed fuel spray shaping air jets, said fuel spray shaping air jets intersecting a fuel spray ejected out of said central fuel ejection nozzle to generate a narrower final fuel spray.

19. The fuel injection system as defined in claim 18, wherein the shaped final fuel spray has a non-circular cross-sectional shape.

20. The fuel injection system as defined in claim 18, wherein the final fuel spray is substantially elliptical in cross-sectional shape, defining a major axis parallel to said transverse axis and a minor axis perpendicular thereto.

21. The fuel injection system as defined in claim 18, wherein the transverse axis is substantially tangent to an annular axis interconnecting the fuel nozzles about the manifold.

22. The fuel injection system as defined in claim 18, wherein said first and second groups of airflow passages are symmetric with respect to said transverse axis.

23. The fuel injection system as defined in claim 18, wherein the spray tip includes a central portion mounted to a nozzle body and a separate air swirler portion mounted to the central portion, the central portion including the central fuel ejection nozzle formed therein, and the first and second groups of airflow passages being disposed in said separate air swirler portion.

24. The fuel injection system as defined in claim 18, wherein said fuel-spray shaping airflow passages have substantially circular cross-sectional areas.

25. The fuel injection system as defined in claim 18, wherein said spray tips are substantially circular.

* * * * *